US006824936B1

(12) United States Patent
Rosiek et al.

(10) Patent No.: US 6,824,936 B1
(45) Date of Patent: Nov. 30, 2004

(54) HINDERED AMINE LIGHT STABILIZER FOR IMPROVED YELLOW DARK STABILITY

(75) Inventors: Thomas A. Rosiek, Rochester, NY (US); Elizabeth K. Priebe, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/634,710

(22) Filed: Aug. 5, 2003

(51) Int. Cl.[7] ..... G03C 1/79; G03C 1/795; G03C 1/825; G03C 7/30; B41M 5/20

(52) U.S. Cl. ..... 430/17; 430/201; 430/372; 430/536; 430/538; 430/551; 430/216; 428/32.1; 428/32.9

(58) Field of Search ..... 430/17, 201, 216, 430/536, 538, 372, 551; 428/32.1, 32.9

(56) References Cited

U.S. PATENT DOCUMENTS

| | | | | |
|---|---|---|---|---|
| 3,411,908 | A | | 11/1968 | Crawford et al. |
| 3,582,337 | A | | 6/1971 | Griggs et al. |
| 4,283,486 | A | | 8/1981 | Aono et al. |
| 4,352,861 | A | | 10/1982 | VanMeer et al. |
| 4,377,616 | A | | 3/1983 | Ashcraft et al. |
| 4,481,289 | A | | 11/1984 | Honma |
| 4,562,145 | A | | 12/1985 | Woodward et al. |
| 4,582,785 | A | | 4/1986 | Woodward et al. |
| 4,584,265 | A | * | 4/1986 | Leppard et al. |
| 4,632,869 | A | | 12/1986 | Park et al. |
| 4,758,462 | A | | 7/1988 | Park et al. |
| 5,055,371 | A | | 10/1991 | Lee et al. |
| 5,100,862 | A | | 3/1992 | Harrison et al. |
| 5,104,722 | A | | 4/1992 | Kojima et al. |
| 5,141,685 | A | | 8/1992 | Maier et al. |
| 5,147,678 | A | | 9/1992 | Foerch et al. |
| 5,244,861 | A | | 9/1993 | Campbell et al. |
| 5,326,624 | A | | 7/1994 | Tsubaki et al. |
| 5,429,916 | A | | 7/1995 | Ohshima et al. |
| 5,503,968 | A | | 4/1996 | Lee |
| 5,514,460 | A | | 5/1996 | Surman et al. |
| 5,586,282 | A | | 12/1996 | Iino et al. |
| 5,705,326 | A | | 1/1998 | Kawai |
| 5,824,462 | A | | 10/1998 | Ashida et al. |
| 5,866,282 | A | | 2/1999 | Bourdelais et al. |
| 5,998,119 | A | | 12/1999 | Aylward et al. |
| 6,080,534 | A | | 6/2000 | Aylward et al. |
| 6,171,751 | B1 | * | 1/2001 | Mourey et al. |
| 6,541,547 | B1 | * | 4/2003 | Schmutz et al. |
| 2003/0225191 | A1 | * | 12/2003 | Gugumus |

FOREIGN PATENT DOCUMENTS

| | | |
|---|---|---|
| EP | 0 290 388 | 11/1988 |
| EP | 0 803 377 A1 | 10/1997 |
| WO | WO 93/04400 | 3/1993 |

* cited by examiner

*Primary Examiner*—Richard L. Schilling
(74) *Attorney, Agent, or Firm*—Lynne M. Blank

(57) ABSTRACT

The present invention relates to an imaged element comprising at least one imaged layer comprising at least one yellow dye and a support, wherein said support comprises at least one face side resin layer comprising a material capable of improving the yellow dark stability of said imaged element, wherein said materials has the formula:

30 Claims, No Drawings

HINDERED AMINE LIGHT STABILIZER FOR IMPROVED YELLOW DARK STABILITY

FIELD OF THE INVENTION

The present invention relates to resin coated photographic support papers with improved yellow dark stability.

BACKGROUND OF THE INVENTION

A considerable amount of the photographic base paper used in the world is resin coated. It is used as an image receiving support for prints produced by a number of different photographic processing systems. Imaging paper, particularly photographic imaging paper, requires materials in the image support that provide long term survivability and stability during both display and storage. These properties are most desirable and have significant commercial value.

The resin is normally a polyolefin, for example polyethylene, and the resulting resin coated base papers are substantially impervious to water and photographic chemical processing solutions. Resin coated base papers therefore require less drying time and consequently can be processed more quickly. In addition, resin coated base papers use less processing chemicals and are substantially free from distortion. This is of special concern to prints produced from the negative-positive process, especially color prints, which generally require longer periods of immersion in the processing solutions than is the case with black and white printing paper.

When imaging supports are subject to variations in ambient conditions over long periods of time the image containing and face side resin layers tend to deteriorate into a mass of cracks which are aesthetically undesirable and which, in extreme cases, extend over the entire print completely destroying the image. All polymers are inherently prone to chemical degradation that leads to loss of mechanical properties. The polymers undergo thermal degradation during processing such as extrusion of thin films, and photooxidative degradation with long term exposure to light. Titanium dioxide catalyzes and accelerates both thermal and photooxidative degradation. In the art of resin coating imaging papers, the melt polymers are extruded at high temperatures and are also subjected to high shear forces. These conditions may degrade the polymer, resulting in discoloration and charring, formation of polymer slugs or "gels", and formation of lines and streaks in the extruded film from degraded material deposits on die surfaces. Also, thermally degraded polymer is less robust than nondegraded polymer for long term stability, and may thereby shorten the life of the print.

Hindered phenolic antioxidants are commonly used alone or in combination with secondary antioxidants to stabilize polymers during melt processing, but provide little protection from long term photooxidation. The phenolic type antioxidants also decrease the ability of the resin to adhere to the paper during the high speed extrusion process. They are also responsible for some forms of oxidative atmospheric gas yellowing in prints stored in the dark. This undesirable color may develop on the print or around the print edges with archival keeping, and has been attributed to colored oxidation products of phenolic antioxidants that are formed in the dark in the presence of white pigments, such as titanium dioxide.

U.S. Pat. No. 4,582,785 suggests using a polymeric hindered amines with greater than 2500 molecular weight as the sole stabilizer, which, when added to polyethylene coated photographic papers, can improve their photostability. In this patent, a polymeric hindered amine is claimed as the sole stabilizer for both thermal processing and light stability in a single layer of a polymeric material, polyethylene. The adhesion of the polymeric hindered amine containing resin to the paper is poor. Furthermore, it is desirable to make imaging elements from polymers other than polyethylene or other than polymers in combination with polyethylene. The use of such materials as polyester and or polypropylene may add improved stability and durability to the element, as well as improved gloss and sheen.

U.S. Pat. No. 4,562,145 suggests a photographic base paper in which the resin coating contains a phosphonate stabilizer to substantially inhibit cracking. Moreover, these stabilizers can conveniently be admixed with the resin prior to extrusion coating of the resin on to the support without any significant detriment to the adhesion and quality requirements of the resin coating and may contain other ingredients, such as light stabilizers, which are hindered amines. Preferred monomeric hindered amine light stabilizer are bis{2,2,6,6-tetramethyl-4-piperidinyl}sebacate (sold by Ciba-Geigy under the trade name of "Tinuvin® 770"), "Tinuvin® 622" and "Chimassorb® 944" (abbreviated herein as CHIM 944) by Ciba-Geigy and Chimosa respectively.

There remains a need to provide an imaging support that contains pigments that are extrusion processable at low temperatures and high speeds without drying the paper, creating gels, or creating photoactive products which will fog the photographic emulsion. In addition, the imaging support must have exceptional long term resistance to degradation and embrittlement when exposed to light and other environmental stresses, while providing an imaging support that has exceptional dark stability and prevents discoloration during dark keeping.

PROBLEM TO BE SOLVED

There remains a need for an imaging element which, when stored for extended times in dark storage conditions, experiences improvement in the dark keeping of the yellow dye, thus, extending the useful life of the color photograph yellow image dyes of the imaging element.

SUMMARY OF THE INVENTION

The present invention relates to an imaged element comprising at least one imaged layer comprising at least one yellow dye and a support, wherein the support comprises at least one face side resin layer comprising a material capable of improving the yellow dark stability of the imaged element, wherein the material has the formula:

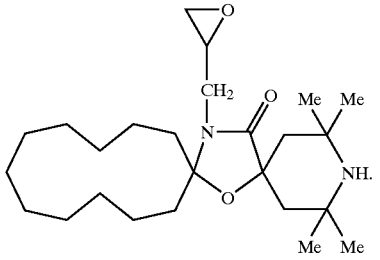

ADVANTAGEOUS EFFECTS OF THE INVENTION

The present invention includes several advantages, not all of which are incorporated in a single embodiment. One advantage provided by the present invention is improved properties after aging. It is a further advantage to provide polyolefin materials that may successfully be extruded at lower temperatures and high speeds onto paper and have improved adhesion of polyolefin layers.

DETAILED DESCRIPTION OF THE INVENTION

The present invention provides an imaging element, which has imaging layers containing at least one yellow dye source applied to a support, preferably photographic paper, having a face side resin layer, also referred to herein as a face side resin coating, which contains a hindered amine light stabilizer.

High temperature, humidity controlled dark ovens are used to generate dark fade responses of these dyes, and these signals can be used to correlate to improved dark fade performance of color photographic materials stored in ambient conditions. The use of a specific long term resin stabilizer in the face side resin of paper support provides an improvement in the dark keeping of the yellow dye. This improvement can extend the useful life of a color photograph.

In order to obtain information on the dark stability of color photographic dyes in a reasonable amount of time, it is common practice to use high temperature and humidity controlled chambers. The results obtained from these chambers can be used to make predictions for the dark keeping of the dyes in ambient conditions. Typical testing conditions include 85 C/50% RH and 75 C/50% RH to generate signals that show improvement in yellow dark fade. The improvement is observed when a specific long term resin stabilizer is used in the face side resin of the support, and certain yellow couplers are coated in the yellow dye forming layer. Results from these high temperature chambers indicate improved yellow dark stability with the imaging element of the present invention. These results imply that there will be a reduction in the amount of yellow dark fade when prints are stored in ambient conditions for extended lengths of time. This property may be used to extend the useful lifetime of color photographs. The presence of the stabilizing material in the imaged element of the present invention may improve the yellow dark stability of the imaged element by greater than 10%.

The terms as used herein, "top", "upper", "emulsion side", "imaging side" and "face" or "face side" mean the side or towards the side of an imaging member bearing the imaging or imaged layers. The terms "bottom", "lower side", and "back" mean the side or towards the side of the imaging member opposite from the side bearing the imaging layers or developed image. The term support as used herein refers to a substrate or base material that is the primary part of an imaging element such as paper, polyester, vinyl, synthetic paper, fabric, or other suitable material for the viewing of images. The imaged element of the present invention may utilize a single technique or may use a hybrid system combining one or more techniques. An example of a hybrid system might be an inkjet printing application on a photographic element.

The support for use in the present invention may be any support typically used in imaging applications. The imaging element of the present invention could further be laminated to a substrate or support to further increase the utility of the imaging element. Typical supports may be fabrics, paper, and polymer sheets. The support may be either transparent or opaque, reflective or non-reflective. Opaque supports include plain paper, coated paper, resin-coated paper such as polyolefin-coated paper, synthetic paper, low density foam core based support, low density foam core based paper, photographic paper support, melt-extrusion-coated paper, and polyolefin-laminated paper. Biaxially oriented supports include a paper base and a biaxially oriented polyolefin sheet, typically polypropylene, laminated to one or both sides of the paper base. The support may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. may be employed. The support may comprise a cast support, a sequentially cast support or a coextruded support.

The preferred reflective support used in the present invention includes a face side resin layer of polymer with a stabilizing amount of hindered amine extruded on the top side of the imaging support. Suitable polymers for the face side resin layer include polyethylene, polypropylene, polymethylpentene, polystyrene, polybutylene, and mixtures thereof. Polyolefin copolymers, including copolymers of polyethylene, propylene and ethylene such as hexene, butene, and octene are also useful. Polyethylene is preferred, as it is low in cost and has desirable coating properties. Usable polyethylenes may include high density polyethylene, low density polyethylene, linear low density polyethylene, and polyethylene blends.

Other suitable polymers include polyesters produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof.

Other polymers are matrix polyesters having repeat units from terephthalic acid or naphthalene dicarboxylic acid and at least one glycol selected from ethylene glycol, 1,4-butanediol and 1,4-cyclohexanedimethanol such as poly (ethylene terephthalate), which may be modified by small amounts of other monomers. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402, and 4,468,510. Useful polyamides include nylon 6, nylon 66, and mixtures thereof.

Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins may also be utilized.

Any suitable white pigment may be incorporated in the face side resins layer, such as, for example, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The preferred pigment is titanium dioxide because of its high refractive index, which gives excellent optical properties at a reasonable cost. The pigment is used in any form that is conveniently dispersed within the polyolefin. The preferred pigment is anatase titanium dioxide. The most preferred pigment is rutile titanium dioxide because it has the highest refractive index at the lowest cost. The average pigment diameter of the rutile $TiO_2$ is most preferably in the range of 0.1 to 0.26 $\mu$m. The pigments that are greater than 0.26 $\mu$m are too yellow for an imaging element application and the pigments that are less than 0.1 $\mu$m are not sufficiently opaque when dispersed in polymers. Preferably, the white pigment should be employed in the range of from about 10 to about 50 percent by weight, based on the total weight of the polyolefin coating. Below 10 percent $TiO_2$, the imaging system will not be sufficiently opaque and will have inferior optical properties. Above 50 percent $TiO_2$, the polymer blend is not manufacturable.

The surface of the $TiO_2$ can be treated with an inorganic compounds such as aluminum hydroxide, alumina with a fluoride compound or fluoride ions, silica with a fluoride compound or fluoride ion, silicon hydroxide, silicon dioxide, boron oxide, boria-modified silica (as described in U.S. Pat. No. 4,781,761), phosphates, zinc oxide or, $ZrO_2$ and with organic treatments such as polyhydric alcohol, polyhydric amine, metal soap, alkyl titanate, polysiloxanes, or silanes. The organic and inorganic $TiO_2$ treatments can be used alone or in any combination. The amount of the surface treating agents is preferably in the range of 0.2 to 2.0% for the inorganic treatment and 0.1 to 1% for the organic treatment, relative to the weight of the titanium dioxide. At these levels of treatment, the $TiO_2$ disperses well in the polymer and does not interfere with the manufacture of the imaging support.

The polymer, hindered amine light stabilizer, and, optionally, the $TiO_2$, may be mixed with each other in the presence of a dispersing agent. Examples of dispersing agents are metal salts of higher fatty acids such as sodium palmitate, sodium stearate, calcium palmitate, sodium laurate, calcium stearate, aluminum stearate, magnesium stearate, zirconium octylate, or zinc stearate higher fatty acids, higher fatty amide, and higher fatty acids. The preferred dispersing agent is sodium stearate and the most preferred dispersing agent is zinc stearate. Both of these dispersing agents give superior whiteness to the resin coated layer.

The present invention provides an imaging element, which has imaging layers applied to a support, preferably photographic paper, having a face side resin coating which contains a stabilizer of formula (I), Formula 1

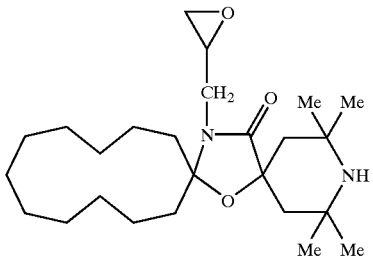

The stabilizer, a hindered amine stabilizer, may comprise a monomeric or polymeric forms of formula (I). Conversion of the monomeric form to the polymeric form may be accomplished as follows:

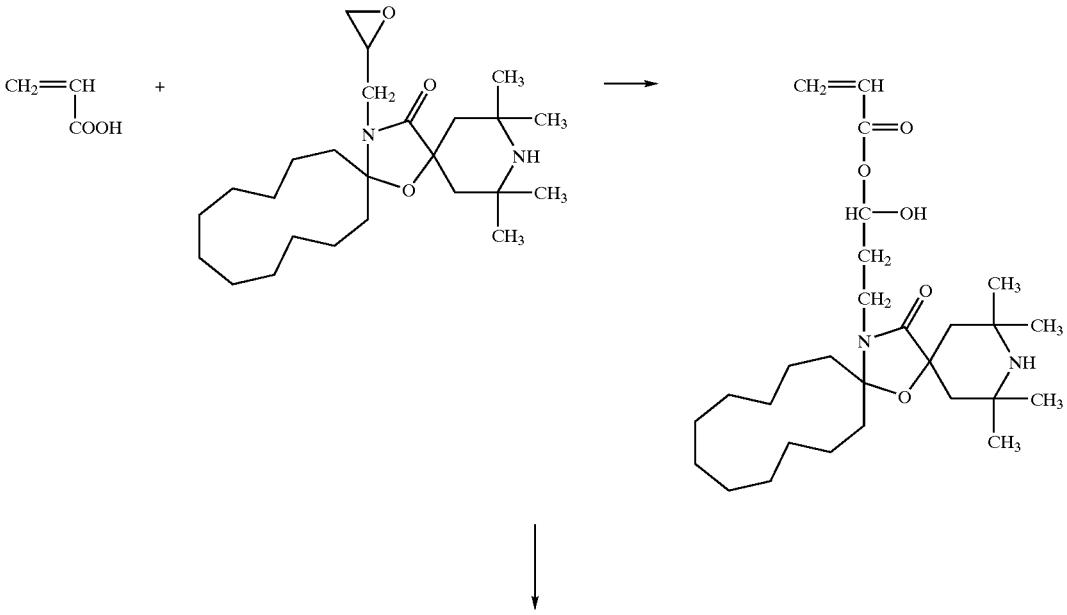

-continued

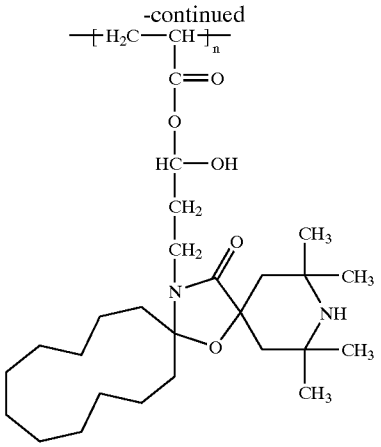

Formula II

The polymeric form is represented by formula II.

Hindered amine light stabilizers (HALS) originate from 2,2,6,6-tertramethylpiperidine. The hindered amine should be added to the polymeric face side resins layer at from 0.01 to 5% by weight of the face side resin layer in order to provide resistance to polymer degradation upon exposure to UV light. The preferred amount is from 0.05 to 3% by weight. This provides excellent polymer stability and resistance to cracking and yellowing while keeping the expense of the hindered amine to a minimum. Examples of suitable hindered amines may include Bis(2,2,6,6-tetramethyl-4-piperidinyl)sebacate, Bis(1,2,2,6,6-pentamethyl-4-piperidinyl)sebacate, Bis(1,2,2,6,6-pentamethyl-4-piperidinyl)2-n-butyl-(3,5-di-tert-butyl-hydroxy-benzyl) malonate, 8-Acetly-3-dodecyl-7,7,9,9-tetramethly-1.3, 8-triazaspirol(4,5)decane-2,4-dione, Tetra(2,2,6,6-tetramethyl-4-piperidinyl)1,2,3,4-butanetetracarboxylate, 1-(-2-[3,5-di-tert-butyl-4-hydroxyphenyl-propionyloxyl] ethyl)-4-(3,5-di-tert-butyl-4-hydroxyphenylpropionyloxy)-2,2,6,6-tetramethylpiperidine, 1,1'-(1,2-ethenadiyl)bis(3,3,5,5-tetramethyl-2-piperazinone). The preferred hindered amine is 1,3,5-triazine-2,4,6-triamine,N,N'"-[1,2-ethanediylbis[[[4,6-bis(butyl(1,2,2,6,6-pentamethyl-4-piperidinyl)amino]-1,3,5-triazine-2-yl]imino]-3,1 propanediyl]]-bis [N',N"-dibutyl-N',N"-bis(1,2,2,6,6-pentamethyl-4-piperidinyl) or 7-oxa-3,20-diazadispiro [5.1.11.2]heneicosan-21-one-2,2,4,4-tetramethyl-20-oxiranylmethyl)-, homopolymer (9CI) (Hostavin N 30, manufactured by Clariant), which will be referred to as Compound A. Compound A is preferred because when mixtures of polymers and Compound A are extruded onto imaging paper the polymer to paper adhesion is excellent and the long term stability of the imaging system against cracking and yellowing is improved. Preferred hindered amines may also have molecular weights of less than 2300.

Processes are known in the art for preparing the stabilizers of formula (I). Briefly, the free acid is prepared by reacting an appropriate hydroxyaralkyl halide with a tertiary phosphite. The free acid may then be converted, if desired, into the metal salt by reacting it with a suitable metal derivative, such as the metal chloride. Alternatively, some of the metal salts can be obtained from commercial supplies and either used as such or converted back to the free acid using, for example, hydrochloric acid. The free acid so obtained may then be used itself in the invention or used as a starting material for conversion into another metal salt.

To form the face side resin coating according to the present invention, a pellet containing the pigment and other additives is subjected to hot melt coating onto a running support of paper or synthetic paper. If desired, the pellet is diluted with a polymer prior to hot melt coating. For a single layer coating the face side resin layer may be formed by lamination. The die is not limited to any specific type and may be any one of the common dies such as a T-slot or coat hanger die. An exit orifice temperature in heat melt extrusion of the resin ranges from 500–660F. Further, before coating the support with resin, the support may be treated with an activating treatment such as corona discharge, flame, ozone, plasma, or glow discharge. The face side resin coating may also be a multiplayer coating, including more than one hindered amine containing layer.

The thickness of the face side resin layer which is applied to the imaging side of a reflective support used in the present invention is preferably in the range of 5 to 100 $\mu$m and most preferably in the range of 10 to 50 $\mu$m. The thickness of the resin layer applied to the support paper on the side opposite the imaging element is preferably in a range from 5 to 100 $\mu$m and more preferably from 10 to 50 $\mu$m.

The surface of the face side resin layer on the imaging side may be a glossy, fine, silk, grain, or matte surface. The surface of the water proof coating on the backside of the paper support, which is not coated with an imaging element, may also be glossy, fine, silk, or matte surface. The preferred water proof surface for the backside is matte. The backside of the paper support may further comprises additional functional layers, for example, a layer adjacent the paper comprising a polyolefin polymer containing a hindered amine light stabilizer. Other functional layers may include antistatic layers, conveyance promoting layers and adhesive layers.

Used herein, the phrase "ink recording element", which may also be referred to as an "imaging element" comprises an imaging support along with an image receiving or recording layer as applicable to multiple techniques governing the transfer of an image onto the imaging element. Such techniques include thermal dye transfer with thermosensitive imaging materials, electrophotographic printing, or inkjet printing, as well as a support for photographic silver halide images. The phrase "imaged element" refers to the element comprised of the support and the developed image, in the case of silver halide elements, or the transferred image, in the case of printed or transferred images, in the case of ink-jet printing or thermal dye transfer. As used herein, the phrase "imaging element" or "photographic element" refers to a material that utilizes photosensitive silver halide in the formation of images.

In the case of thermal dye transfer or ink jet imaging, the imaging layer that is coated on the imaging element may be any material that is known in the art such as gelatin, pigmented latex, polyurethane, polyester, poly(vinyl chloride), poly-(styrene-co-acrylonitrile), polycaprolactone, polyvinyl alcohol, polycarbonate, polyvinyl pyrrolidone, starch, and methacrylate, polymers and copolymers of acyrlic acid, polyethylene oxide, cellulosics such as hydroxymethyl cellulose and porous receivers containing silica, sol-gels, alumina, calcium carbonate, clays, talc, zinc oxide, zeolites, barium sulfate, zinc sulfide, $TiO_2$ or mixtures thereof. Mordants such as cationic polyester sulfonates may also be incorporated. The dye image receiving layer may be present in any amount, which is effective for the intended purpose. An overcoat layer may be further coated over the dye receiving layer such as described in U.S. Pat. No. 4,775,657, the disclosure of which is incorporated by reference. The photographic elements can be single color elements or multicolor elements. Multicolor elements contain image dye forming units sensitive to each of the three primary regions of the spectrum. Each unit can comprise a single emulsion layer or multiple emulsion layers sensitive to a given region of the spectrum. The layers of the element, including the layers of the image forming units, can be arranged in various orders as known in the art. In an alternative format, the emulsions sensitive to each of the three primary regions of the spectrum can be disposed as a single segmented layer.

Inks used to image the recording elements of the present invention are well known in the art. The ink compositions used in inkjet printing typically may be liquid compositions comprising a solvent or carrier liquid, dyes or pigments, humectants, organic solvents, detergents, thickeners, preservatives. The solvent or carrier liquid may be solely water or may be water mixed with other water miscible solvents such as polyhydric alcohols. Inks in which organic materials such as polyhydric alcohols may be the predominant carrier or solvent liquid may also be used. Particularly useful are mixed solvents of water and polyhydric alcohols. The dyes used in such compositions may be typically water soluble direct or acid type dyes. Such liquid compositions have been described extensively in the prior art including, for example, U.S. Pat. Nos. 4,381,946, 4,239,543, and 4,781,758, the disclosures of which are hereby incorporated by reference. The imaged element of the present invention comprises at least one yellow dye resulting from the application of yellow inkjet dye droplets to the inkjet receiving layer.

When used as inkjet imaging media, the recording elements or media typically comprise a substrate or a support material having on at least one surface thereof an ink receiving or recording/recording or image forming layer. If desired, in order to improve the adhesion of the inkjet receiving or recording layer to the support, the surface of the support may be corona discharge treated prior to applying the solvent absorbing layer to the support or, alternatively, an undercoating, such as a layer formed from a halogenated phenol or a partially hydrolyzed vinyl chloride-vinyl acetate copolymer, may be applied to the surface of the support. The inkjet receiving or recording layer may be preferably coated onto the support layer from water or water-alcohol solutions at a dry thickness ranging from 3 to 75 micrometers, preferably 8 to 50 micrometers.

Any known inkjet receiver layer may be used in combination with other particulate materials. For example, the ink receiving or recording layer may consist primarily of inorganic oxide particles such as silicas, modified silicas, clays, aluminas, fusible beads such as beads comprised of thermoplastic or thermosetting polymers, nonfusible organic beads, or hydrophilic polymers such as naturally occurring hydrophilic colloids and gums such as gelatin, albumin, guar, xantham, acacia, chitosan, starches and their derivatives, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly(ethylene imine), poly(acrylic acid), poly (methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the support and in various combinations within a layer.

A porous structure may be introduced into ink receiving or recording layers comprised of hydrophilic polymers by the addition of ceramic or hard polymeric particulates, by foaming or blowing during coating, or by inducing phase separation in the layer through introduction of nonsolvent. In general, it is preferred for the base layer to be hydrophilic, but not porous. This may be especially true for photographic quality prints, in which porosity may cause a loss in gloss. In particular, the ink receiving or recording layer may consist of any hydrophilic polymer or combination of polymers with or without additives as is well known in the art.

If desired, the ink receiving or recording layer may be overcoated with an ink permeable, anti-tack protective layer such as, for example, a layer comprising a cellulose derivative or a cationically modified cellulose derivative or mixtures thereof. An especially preferred overcoat is poly β-1, 4-anhydro-glucose-g-oxyethylene-g-(2'-hydroxypropyl)-N, N-dimethyl-N-dodecylammonium chloride. The overcoat layer may be non porous, but may be ink permeable and serves to improve the optical density of the images printed on the element with water based inks. The overcoat layer may also protect the ink receiving or recording layer from abrasion, smudging, and water damage. In general, this overcoat layer may be present at a dry thickness of from 0.1 to 5 $\mu$m, preferably from 0.25 to 3 $\mu$m.

In practice, various additives may be employed in the ink receiving or recording layer and overcoat. These additives include surface active agents such as surfactant(s) to improve coatability and to adjust the surface tension of the dried coating, acid or base to control the pH, antistatic agents, suspending agents, antioxidants, hardening agents to crosslink the coating, antioxidants, UV stabilizers, light stabilizers and melt stabilizing addenda. In addition, a mordant may be added in small quantities (2%–10% by weight of the base layer) to improve waterfastness. Useful mordants are disclosed in U.S. Pat. No. 5,474,843.

The layers described above, including the ink receiving or recording layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating. Some of these methods allow for simultaneous coatings of both layers, which is preferred from a manufacturing economic perspective.

The IRL (ink or dye receiving layer) may be coated over a tie layer (TL). There are many known formulations, which may be useful as ink or dye receiving or recording layers.

The primary requirement is that the IRL is compatible with the inks which it will be imaged so as to yield the desirable color gamut and density. As the ink drops pass through the IRL, the ink or dyes may be retained or mordanted in the IRL, while the ink solvents pass freely through the IRL and may be rapidly absorbed by the TL. Additionally, the IRL formulation may be preferably coated from water, exhibits adequate adhesion to the TL, and allows for easy control of the surface gloss.

For example, Misuda et al in U.S. Pat. Nos. 4,879,166, 5,264,275, 5,104,730, 4,879,166, and Japanese Patents 1,095,091, 2,276,671, 2,276,670, 4,267,180, 5,024,335, and 5,016,517 disclose aqueous based IRL formulations comprising mixtures of psuedo-bohemite and certain water soluble resins. Light in U.S. Pat. Nos. 4,903,040, 4,930,041, 5,084,338, 5,126,194, 5,126,195, and 5,147,717 discloses aqueous based IRL formulations comprising mixtures of vinyl pyrrolidone polymers and certain water dispersible and/or water soluble polyesters, along with other polymers and addenda. Butters et al in U.S. Pat. Nos. 4,857,386 and 5,102,717 disclose ink absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous coatable IRL formulations based on poly(vinyl alcohol). Iqbal in U.S. Pat. No. 5,208,092 discloses water based IRL formulations comprising vinyl copolymers, which may be subsequently crosslinked. In addition to these examples, there may be other known or contemplated IRL formulations, which are consistent with the aforementioned primary and secondary requirements of the IRL, all of which fall under the spirit and scope of the current invention.

The IRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers.

It may also be desirable to overcoat the IRL for the purpose of enhancing the durability of the imaged element. Such overcoats may be applied to the IRL either before or after the element is imaged. For example, the IRL may be overcoated with an ink permeable layer through which inks freely pass. Layers of this type are described in U.S. Pat. Nos. 4,686,118, 5,027,131, and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, that is, continuous, piezoelectric, or thermal. Therefore, depending on the specific ink process, the inks may contain widely differing amounts and combinations of solvents, colorants, preservatives, surfactants, humectants. Inks preferred for use in combination with the image recording elements of the present invention may be water based. However, it is intended that alternative embodiments of the image recording elements as described above, which may be formulated for use with inks which may be specific to a given ink recording process or to a given commercial vendor, fall within the scope of the present invention.

For thermal imaged elements, the thermal ink or dye image receiving or recording layer of the receiving or recording elements of the invention may comprise, for example, a polycarbonate, a polyurethane, a polyester, polyvinyl chloride, poly(styrene-co-acrylonitrile), poly (caprolactone), or mixtures thereof. The ink or dye image receiving or recording layer may be present in any amount that may be effective for the intended purpose. An overcoat layer may be further coated over the ink or dye receiving or recording layer, such as described in U.S. Pat. No. 4,775,657 of Harrison et al.

Ink or dye donor elements that may be used with the ink or dye receiving or recording element of the invention conventionally comprise a support having thereon an ink or dye containing layer. Any ink or dye may be used in the ink or dye donor employed in the invention, provided it is transferable to the ink or dye receiving or recording layer by the action of heat. Ink or dye donors applicable for use in the present invention are described, for example, in U.S. Pat. Nos. 4,916,112, 4,927,803, and 5,023,228. As noted above, ink or dye donor elements may be used to form an ink or dye transfer image. Such a process comprises image-wise heating an ink or dye donor element and transferring an ink or dye image to an ink or dye receiving or recording element as described above to form the ink or dye transfer image. The thermal ink or dye transfer method of printing, an ink or dye donor element may be employed which comprises a poly(ethylene terephthalate) support coated with sequential repeating areas of cyan, magenta, and yellow ink or dye, and the ink or dye transfer steps may be sequentially performed for each color to obtain a three color ink or dye transfer image. When the process is only performed for a single color, then a monochrome ink or dye transfer image may be obtained. The imaged element of the present invention comprises yellow dye resulting from the application of yellow dye from a thermal dye donor element.

Dye donor elements that may be used with the dye receiving element of the invention conventionally comprise a support having thereon a dye containing layer. Any dye may be used in the dye donor employed in the invention provided it is transferable to the dye receiving layer by the action of heat. Especially good results have been obtained with sublimable dyes. Dye donors applicable for use in the present invention are described, for example, in U.S. Pat. Nos. 4,916,112, 4,927,803 and 5,023,228, the disclosures of which are incorporated by reference. Specific examples of such dyes include the following:

Magenta Dye M-1

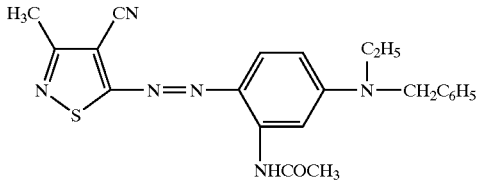

Magenta Dye M-2

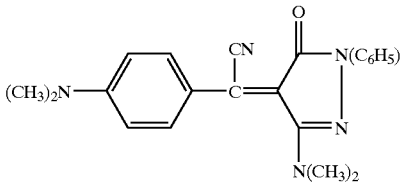

-continued

Magenta Dye M-3

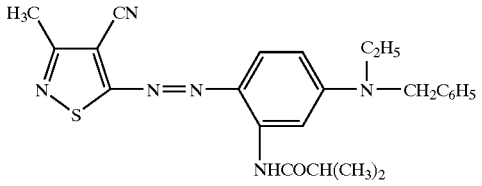

Yellow Dye Y-1

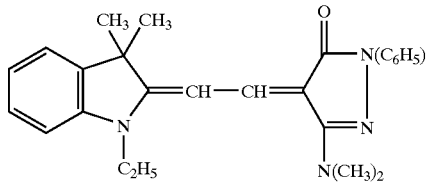

Yellow Dye Y-2

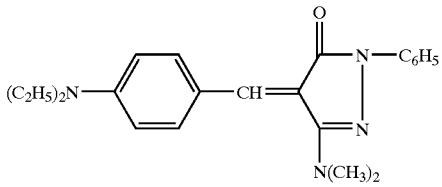

Cyan Dye C-1

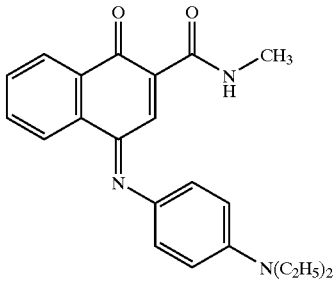

Cyan Dye C-2

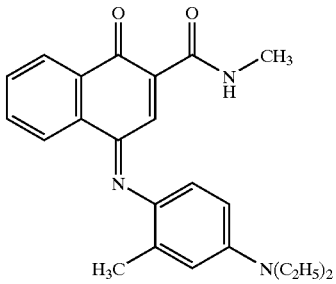

Cyan Dye C-3

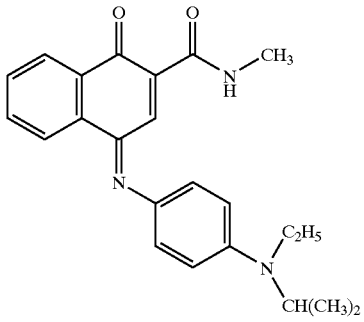

As noted above, dye donor elements may be used to form a dye transfer image. Such a process comprises imagewise heating a dye donor element and transferring a dye image to a dye receiving element as described above to form the dye transfer image.

In a preferred embodiment of the invention, a dye donor element may be employed which comprises a poly(ethylene terephthalate) support coated with sequential repeating areas of cyan, magenta and yellow dye, and the dye transfer steps are sequentially performed for each color to obtain a three color dye transfer image. Of course, when the process is only performed for a single color, then a monochrome dye transfer image may be obtained. The dye donor element may also contain a colorless area which may be transferred to the receiving element to provide a protective overcoat. This protective overcoat may be transferred to the receiving element by heating uniformly at an energy level equivalent to 85% of that used to print maximum image dye density.

Thermal printing heads which may be used to transfer ink or dye from ink or dye donor elements to receiving or recording elements of the invention may be available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, GB No. 2,083,726A.

A thermal ink or dye transfer assemblage may comprise (a) an ink or dye donor element, and (b) an ink or dye receiving or recording element as described above, the ink or dye receiving or recording element being in a superposed relationship with the ink or dye donor element so that the ink or dye layer of the donor element may be in contact with the ink or dye image receiving or recording layer of the receiving or recording element.

When a three color image is to be obtained, the above assemblage may be formed on three occasions during the time when heat may be applied by the thermal printing head. After the first dye is transferred, the elements may be peeled apart. A second dye donor element (or another area of the donor element with a different dye area) may be then brought in register with the dye receiving or recording element and the process repeated. The third color may be obtained in the same manner.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40C to 70C, and maintained for a period of time. The precipitation and spectral and chemical sensitization methods utilized in preparing the emulsions employed in the invention can be those methods known in the art.

For photographic use, a white support with a slight bluish tint is preferred. The layers of the resin coating preferably contain tinting agents or colorants, preferably red or blue, such as a bluing agent and magenta or red pigment. Applicable bluing agents may include commonly know ultramarine blue, cobalt blue, oxide cobalt phosphate, quinacridone pigments, and a mixture thereof. Applicable red or magenta colorants may be quinacridones and ultramarines. Preferable colorants may comprise cobalt or aluminate colorants.

The resin may also include a fluorescing agent, which absorb energy in the UV region and emit light largely in the blue region. Any of the optical brighteners referred to in U.S. Pat. No. 3,260,715 or a combination thereof would be beneficial.

The resin may also contain other stabilizers, for example, antioxidant(s) such as hindered phenol primary antioxidants used alone or in combination with secondary antioxidants. Examples of hindered phenol primary antioxidants include pentaerythrityl tetrakis [3-(3,5-di-tert-butyl-4-hydroxyphenyl) proprionate] (such as Irganox® 1010), octadecyl 3-(3,5-di-tert-butyl-4-hydroxyphenyl)proprionate (such as Irganox® 1076 which will be referred to as compound B), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox® MD1024), 2,2'-thiodiethylenebis[3-(3,5-di-tert-butyl-4-hydroxyphenyl)proprionate] (such as Irganox® 1035), 1,3,5-trimethyl-2,4,6-tri(3,5-di-tert-butyl-4-hydroxybenzyl) benzene (such as Irganox® 1330), but are not limited to these examples. Secondary antioxidants include organic alkyl and aryl phosphites including examples such as triphenylphosphite (such as Irgastab® TPP), tri(n-propylphenylphophite) (such as Irgastab® SN-55), 2,4-bis(1,1-dimethylphenyl) phosphite (such as Irgafos® 168).

The hindered amine light stabilizer, $TiO_2$, colorants, slip agents, optical brightener, and antioxidant are incorporated either together or separately with the polymer using a continuous or Banburry mixer. A concentrate of the additives in the form of a pellet is typically made. The concentration of the rutile pigment can be from 20% to 80% by weight of the masterbatch. The master batch is then adequately diluted for use with the resin.

For photographic applications, chemical sensitization of the emulsion typically employs sensitizers such as: sulfur containing compounds, that is, allyl isothiocyanate, sodium thiosulfate and allyl thiourea, reducing agents, that is, polyamines and stannous salts, noble metal compounds, that is, gold, platinum, and polymeric agents, that is, polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride, and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in The Theory of the Photographic Process, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives, tin compounds, polyamine compounds, and thiourea dioxide based compounds described in U.S. Pat. Nos. 2,487,850, 2,512,925, and British Patent 789, 823. Specific examples of reduction sensitizers or conditions, such as dimethylamineborane, stannous chloride, hydrazine, high pH (pH 8–11), and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The invention may be utilized with the materials disclosed in Research Disclosure, September 1997, Item 40145. The invention is particularly suitable for use with the material color paper examples of sections XVI and XVII. The couplers of section II are also particularly suitable. The Magenta I couplers of section II, particularly M-7, M-10, M-11, and M-18, are particularly desirable.

The photographic elements of this invention may use emulsions doped with Group VIII metals such as iridium, rhodium, osmium, and iron as described in Research Disclosure, September 1996, Item 38957, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image forming unit comprising at least one red sensitive silver halide emulsion layer having associated therewith at least one cyan dye forming coupler, a magenta image forming unit comprising at least one green sensitive silver halide emulsion layer having associated therewith at least one magenta dye forming coupler, and a yellow dye image forming unit comprising at least one blue sensitive silver halide emulsion layer having associated therewith at least one yellow dye forming coupler. The element may contain additional layers, such as filter layers, interlayers, overcoat layers, subbing layers, and the like. The support of the invention may also be utilized for black and white photographic print elements.

Any yellow dye forming coupler known to those skilled in the art may be utilized with the present invention. Prefereably, the yellow dye forming coupler comprises an acetanilide-based yellow dye forming coupler known in the art which can be prepared by techniques known to those skilled in the art. Individual yellow couplers may be used singly or in combinations. Couplers that form yellow dyes upon reaction with oxidized color developing agent and which are useful in elements of the invention are described, e.g., in such representative patents and publications as: U.S. Pat. Nos. 2,875,057, 2,407,210, 3,265,506, 2,298,443, 3,048,194, 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552, 510,535, 524,540, 543,367, and U.S. Pat. No. 5,238,803.

Typical preferred acetanilide-based yellow couplers are represented by the following formulas:

YELLOW-1

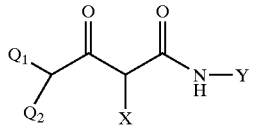

YELLOW-2

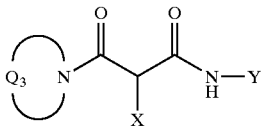

YELLOW-3

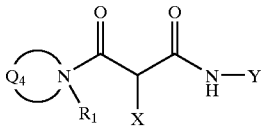

YELLOW-4

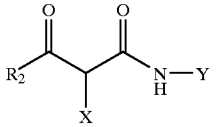

wherein $R_1$, $R_2$, $Q_1$ and $Q_2$ each represent a substituent, X is hydrogen or a coupling-off group, Y represents an aryl group or a heterocyclic group, $Q_3$ represents an organic residue required to form a nitrogen containing heterocyclic group together with the illustrated nitrogen atom, and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Preferred couplers are of YELLOW-I and YELLOW-4 wherein $Q_1$ and $Q_2$ each represent an alkyl group, an aryl group, or a heterocyclic group, and $R_2$ represents an aryl or alkyl group, including cycloalkyl and bridged cycloalkyl groups, and more preferably a tertiary alkyl group. Particularly preferred yellow couplers for use in elements of the invention are represented by YELLOW-4, wherein $R_2$ represents a tertiary alkyl group and Y represents an aryl group, and X represents an aryloxy or N-heterocyclic coupling-off group. The elements of the invention are particularly useful in combination with yellow couplers of the above formulas wherein X represents a nitrogen containing heterocyclic coupling-off group.

Specific examples of yellow couplers are:

YC1

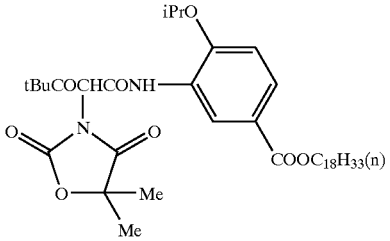

YC2

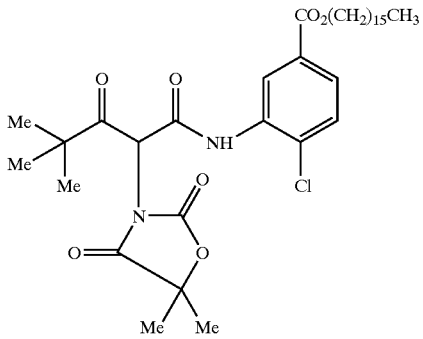

YC3

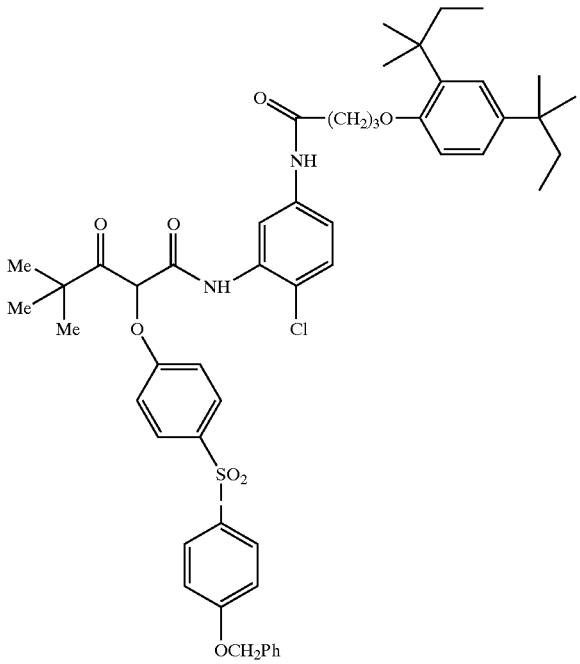

-continued
YC4
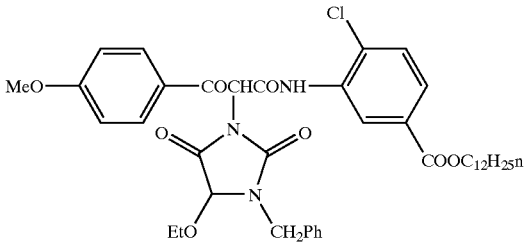
YC5
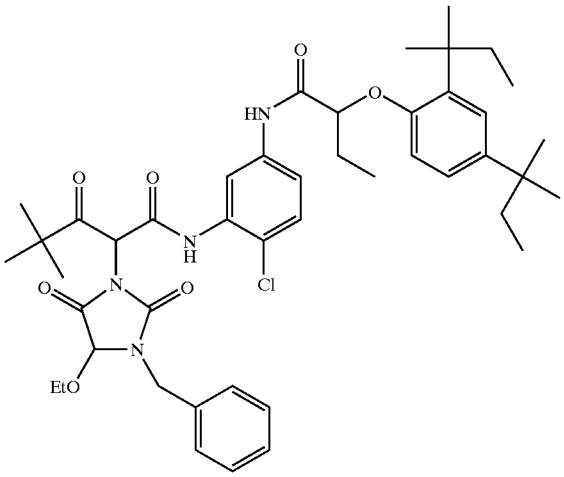
YC6
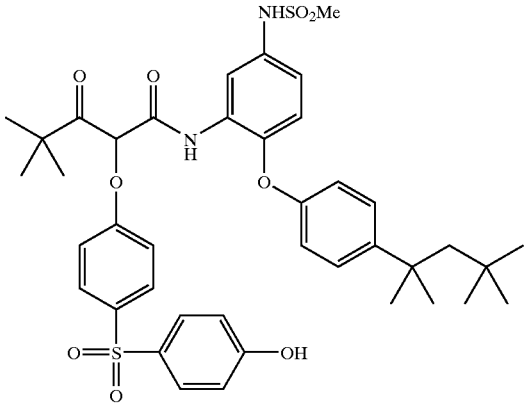
YC7
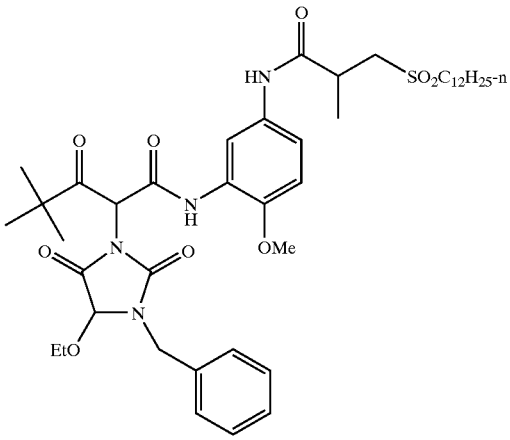
-continued
YC8
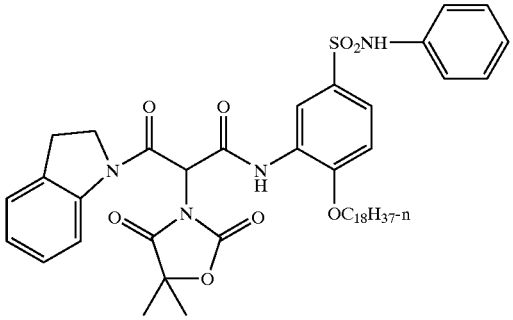
YC9+
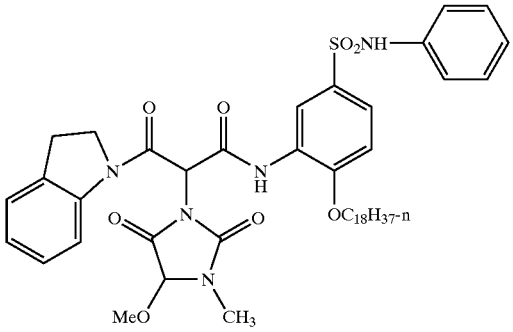
YC10
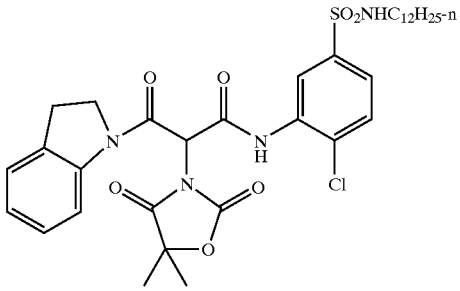
YC11
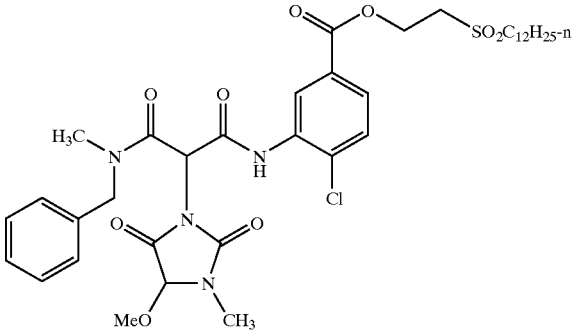
YC12
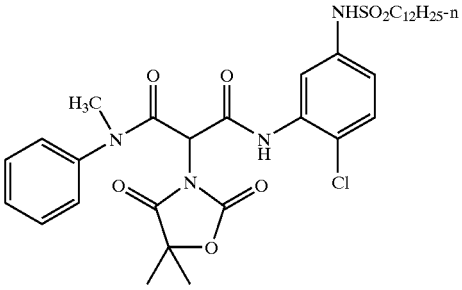

-continued
YC13
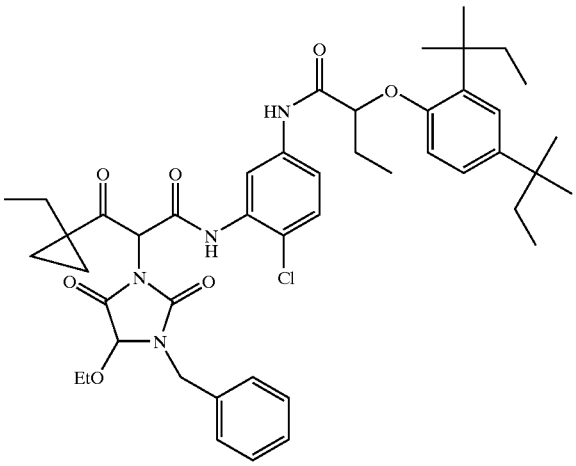
YC14
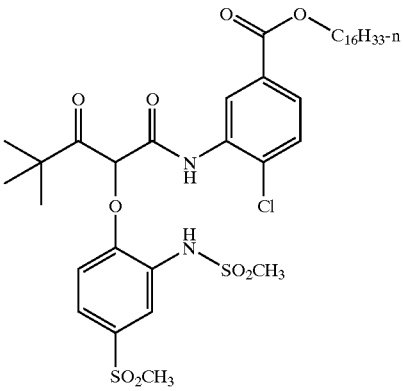
YC15
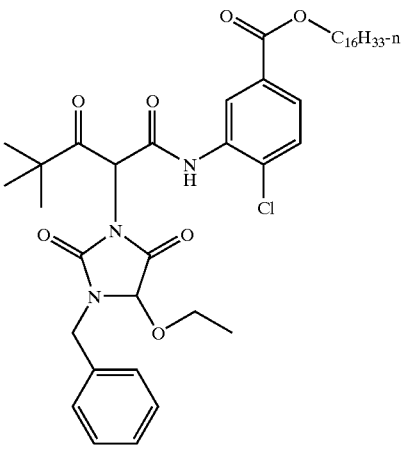
-continued
YC16
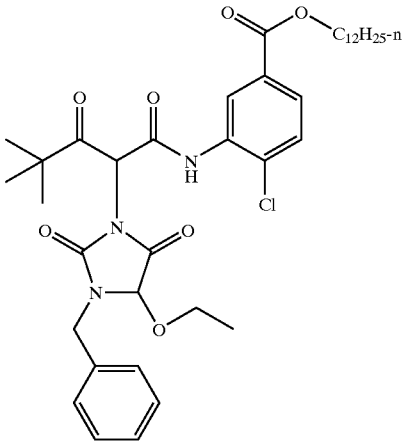
YC17
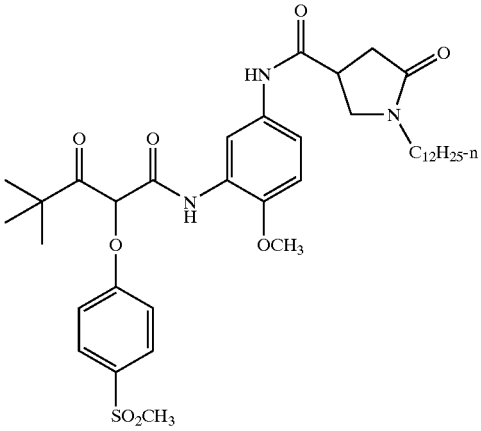
YC18
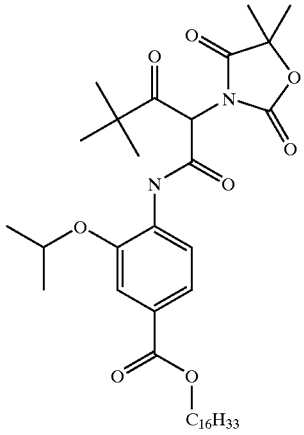
Representative cyan couplers which may be used in the elements of the invention include the following:

C-1
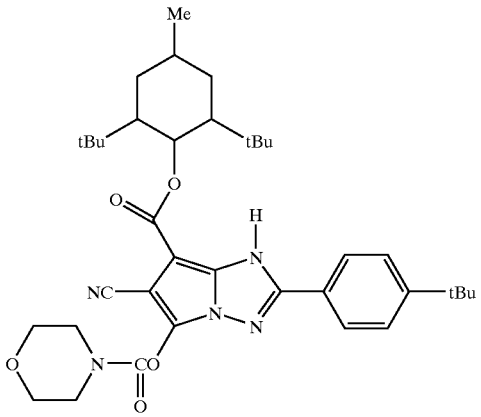
C-2
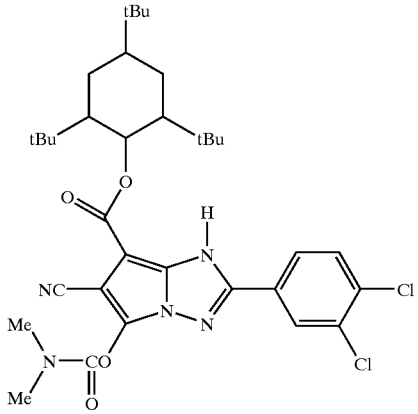
C-3
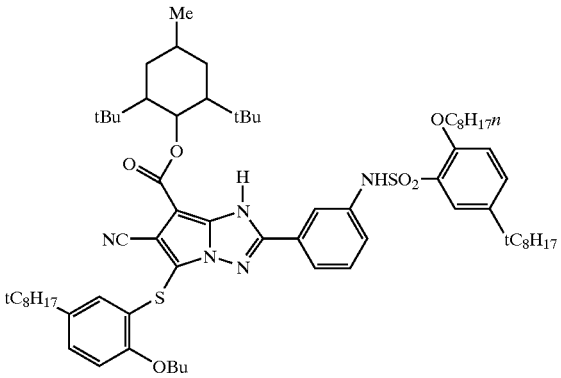
C-4
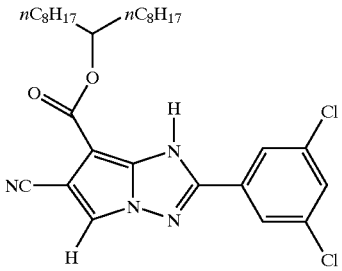
-continued
C-5
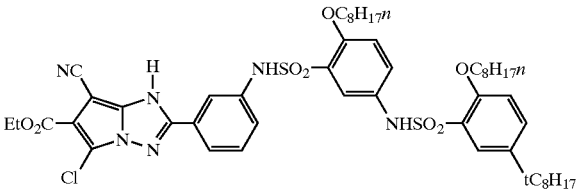
Representative magenta couplers which may be used in the elements of the invention include the following:
M-1
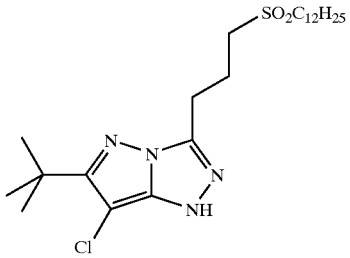
M-2
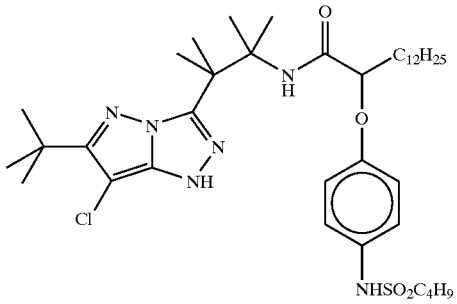
M-3
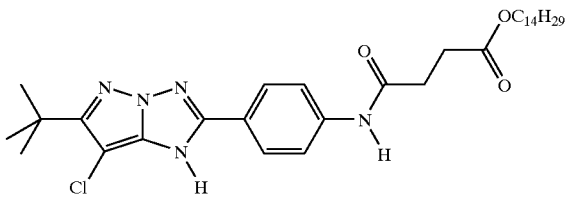

-continued
M-4
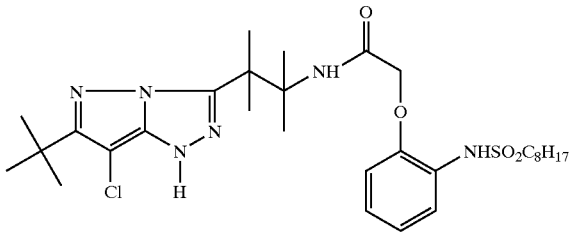
M-5
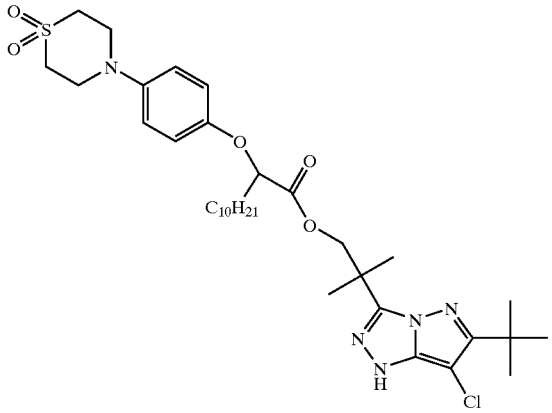
-continued
M-6
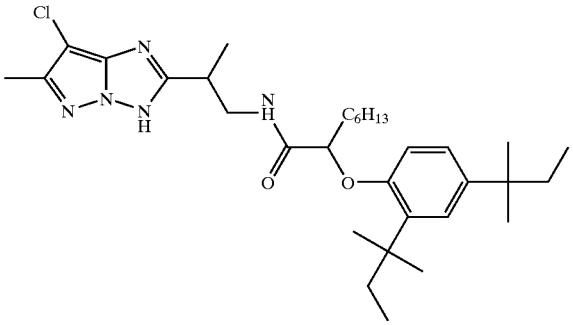
M-7
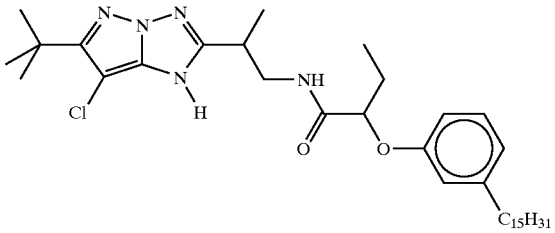
Representative stabilizers and scavengers which may be used in the elements of the invention may include the following:
ST-1
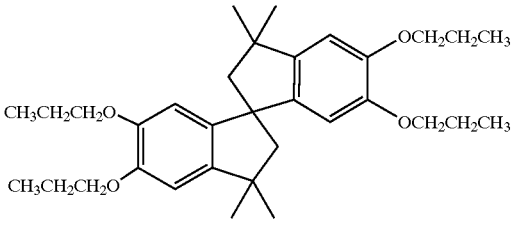
ST-2
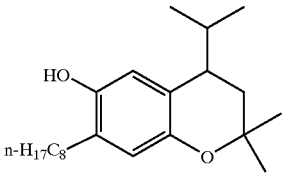
ST-3
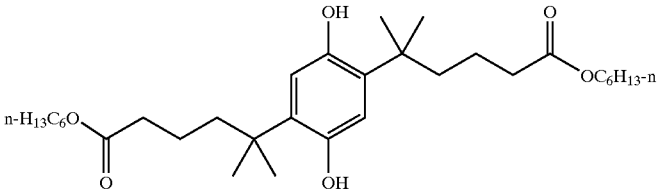
ST-4
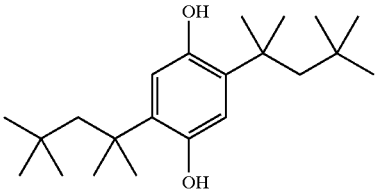

-continued
ST-5
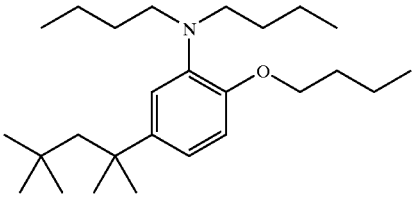
ST-6
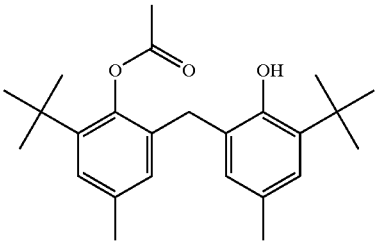
ST-7
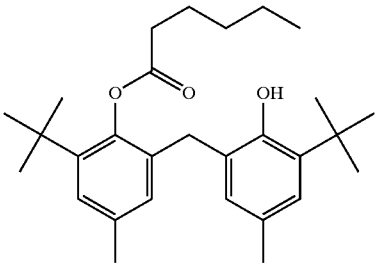
ST-8
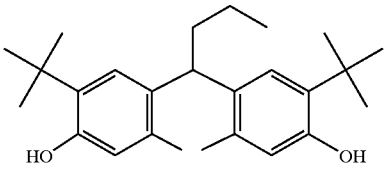
ST-9
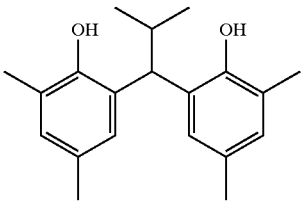
ST-10
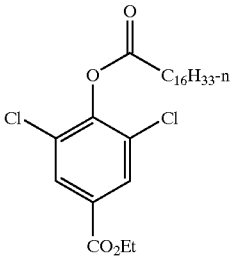
ST-11
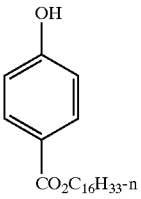

-continued
ST-12
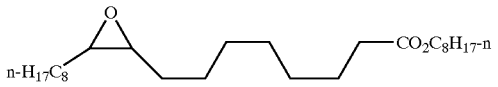
ST-13
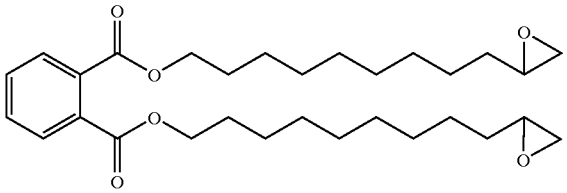
ST-14
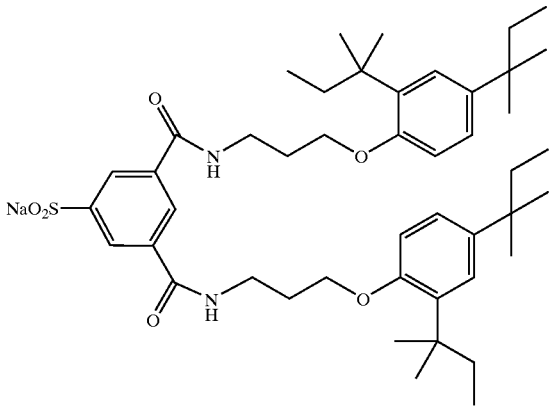
ST-15
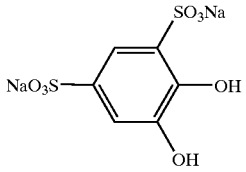
ST-16
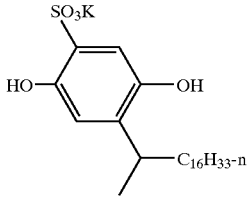
ST-17
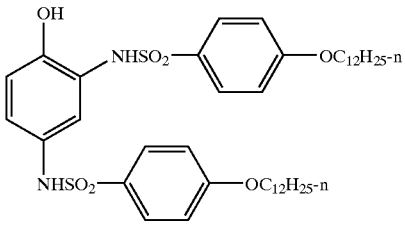
ST-18
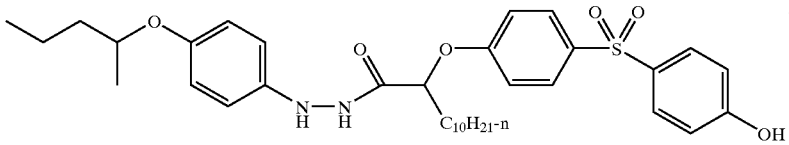
ST-19
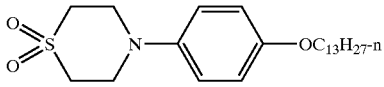

-continued
ST-20
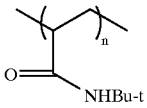
n = 75–8,000
ST-21
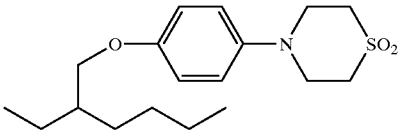
ST-22
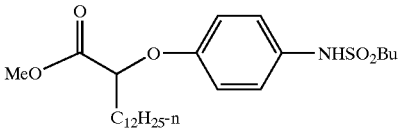
ST-23
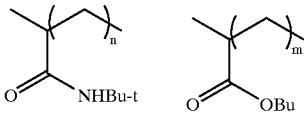
n:m 1:1 mw = 75–100,000
ST-24
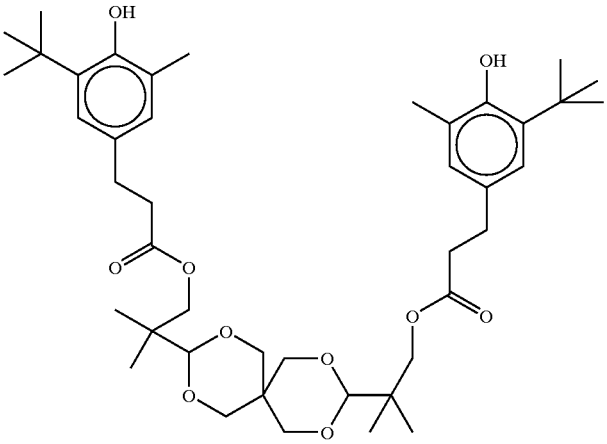
ST-25
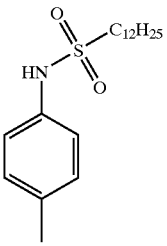

-continued

| | |
|---|---|
| N-tert-butylacrylamide/n-butyl acrylate 50/50 copolymer latex, 40 micron diameter | ST-26 |

Examples of solvents which may be used in the present invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |
| Oleyl Alcohol | S-11 |

-continued

| | |
|---|---|
| Dibutyl sebacate | S-12 |
| Tributyl citrate | S-13 |

The dispersions used in photographic elements may also include ultraviolet (UV) stabilizers and so called liquid UV stabilizers, as described in U.S. Pat. Nos. 4,992,358, 4,975,360, and 4,587,346. Polymeric UV stabilizers may also be used, in particular, the benzotriazole-based UV absorbing polymers as described in U.S. Pat. No. 5,610,000. Representative examples of UV stabilizers are shown below:

UV-1

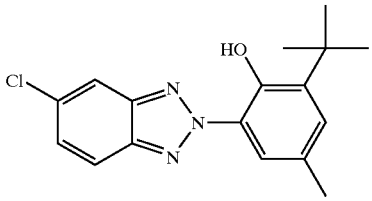

UV-2

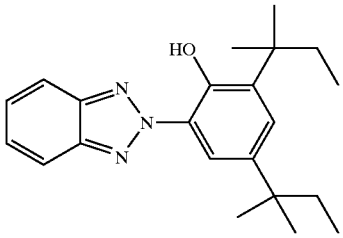

UV-3

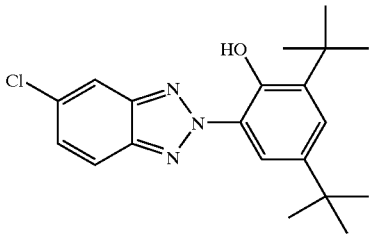

-continued
UV-4
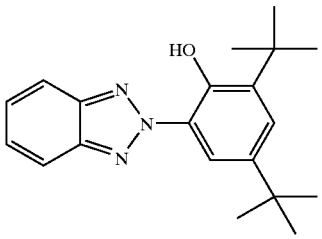
UV-5
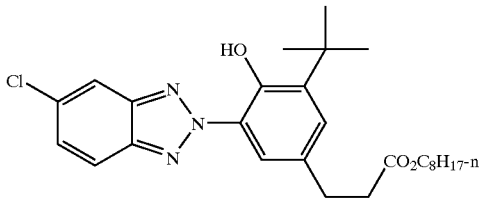
UV-6
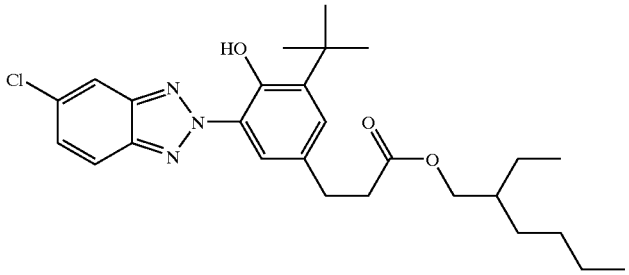
UV-7
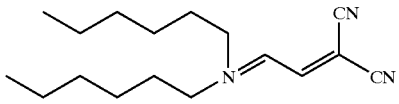
UV-8
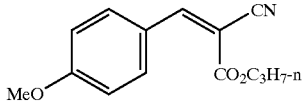
The preferred UV absorbing monomers UV-9 and UV-10 are depicted below and can be polymerized to form oligomers where the number of monomer units is 3 to 10 or to form higher polymers with the number of monomer units per molecule in excess of 10.

UV-9

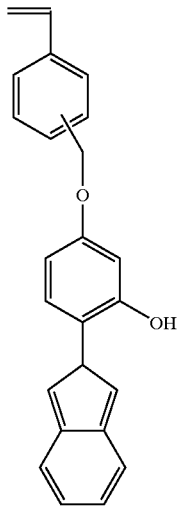

(mixture of m- and p- subsitutions)

UV-10

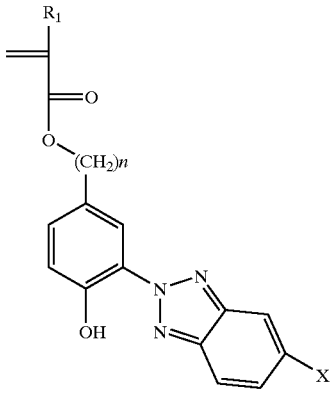

$R_1$ = H or $CH_3$
n = 1–4
X = H or Cl

With respect to the yellow dye forming couplers described above, a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo, alkoxy, particularly those with 1 to 6 carbon atoms (for example, methoxy, ethoxy), substituted or unsubstituted alkyl, particularly lower alkyl (for example, methyl, trifluoromethyl), alkenyl or thioalkyl (for example, methylthio or ethylthio), particularly either of those with 1 to 6 carbon atoms, substituted and unsubstituted aryl, particularly those having from 6 to 20 carbon atoms (for example, phenyl), and substituted or unsubstituted heteroaryl, particularly those having a 5 or 6-membered ring containing 1 to 3 heteroatoms selected from N, O, or S (for example, pyridyl, thienyl, furyl, pyrrolyl), and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following Table, reference will be made to (1) Research Disclosure, December 1978, Item 17643, (2) Research Disclosure, December 1989, Item 308119, and (3) Research Disclosure, September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

Reference Section Subject Matter
1 I, II Grain composition,
2 I, II, IX, X, XI, morphology and preparation.
XII, XIV, XV Emulsion preparation.
I, II, III, IX including hardeners, coating
3 A & B aids, addenda, etc.
1 III, IV Chemical sensitization and
2 III, IV spectral sensitization/
3 IV, V desensitization
1 V UV dyes, optical brighteners,
2 V luminescent dyes
3 VI
1 VI Antifoggants and stabilizers
2 VI
3 VII
1 VIII Absorbing and scattering
2 VIII, XIII, XVI materials, Antistatic layers,
3 VIII, IX C & D matting agents
1 VII Image-couplers and image-
2 VII modifying couplers, Dye
3 X stabilizers and hue modifiers
1 XVII Supports
2 XVII
3 XV
3 XI Specific layer arrangements
3 XII, XIII Negative working emulsions,
Direct positive emulsions
2 XVIII Exposure
3 XVI
1 XIX, XX Chemical processing,
2 XIX, XX, XXII Developing agents
3 XVIII, XIX, XX
3 XIV Scanning and digital
processing procedures The photographic elements can be exposed with various forms of energy which encompass the ultraviolet, visible, and infrared regions of the electromagnetic spectrum as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™. (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated. Molecular weights are number average unless otherwise indicated.

EXAMPLES

Support Base

The support for the examples was prepared by applying the experimental, comparison or control face-side coatings to a paper base with a back-side coating of unpigmented polyethylene. The paper base was produced using a standard fourdrinier paper machine and a blend of mostly bleached hardwood Kraft fibers. The fiber ratio consisted primarily of bleached poplar (38%) and maple/beech (37%) with lesser amounts of birch (18%) and softwood (7%). Paper was made to a 173 g/m$^2$ basis weight with acid sizing chemistry; surface sizing using hydroxyethylated starch and sodium chloride. The paper was then calendered to an apparent density of 1.08 g/cc.

The coating structure for the imaging layers utilized with the examples is represented by Coating Format 1. Aqueous gelatin solutions of the compositions for each layer were coated simultaneously onto the face-side layer of the resin coated papers of the invention and their comparisons.

Coating Format 1

| | | Laydown mg/m$^2$ |
|---|---|---|
| Layer 1 | Blue Sensitive Layer | |
| | Gelatin | 1244 |
| | Blue sensitive silver (Blue EM-1) | 209 |
| | YC-2 | 414 |
| | ST-24 | 129 |
| | ST-26 | 414 |
| | S-13 | 231 |
| Layer 2 | Interlayer | |
| | Gelatin | 650 |
| | ST-4 | 55 |
| | S-2 | 160 |
| Layer 3 | Green Sensitive Layer | |
| | Gelatin | 1100 |
| | Green sensitive silver (Green EM-1) | 70 |
| | M-1 | 270 |
| | S-2 | 75 |
| | S-3 | 32 |
| | ST-8 | 20 |
| | ST-21 | 165 |
| | ST-22 | 530 |
| Layer 4 | Interlayer | |
| | Gelatin | 650 |
| | ST-4 | 55 |
| | S-2 | 160 |
| Layer 5 | Red Sensitive Layer | |
| | Gelatin | 1200 |
| | Red sensitive silver | 170 |
| | C-0 | 365 |
| | S-2 | 360 |
| | UV-2 | 235 |
| | S-9 | 30 |
| | ST-4 | 3 |
| Layer 6 | UV Overcoat | |
| | Gelatin | 440 |
| | UV-1 | 20 |

-continued

Coating Format 1

| | | Laydown mg/m$^2$ |
|---|---|---|
| | UV-2 | 110 |
| | ST-4 | 30 |
| | S-10 | 20 |
| | S-2 | 20 |
| Layer 7 | SOC | |
| | Gelatin | 490 |
| | ST-4 | 17 |
| | $SiO_2$ | 200 |
| | Surfactant | 2 |

Example 1

Sample 1

A face side resin coated layer was applied by extrusion coating to a paper support. The face side resin layer contained 12.5 wt %. titanium dioxide (APG, a commercially available anatase TiO2 from Huntsman Tioxide), 0.1 wt %. processing stabilizer (Irganox® 1076 from Ciba Specialty Chemicals Corporation), 3.0 wt % light stabilizer (Kadox® 930 ZnO from Zinc Corporation of America), and 0.5 wt %. calcium stearate, and the balance was low-density polyethylene (LDPE, D4002P from Eastman Chemical Company). The total laydown of the coated resin layer was 25.9 grams per square meter.

Samples 2 through 27 were prepared as sample 1, except that one or more of the components in the face-side resin were changed as shown in the following table.

TABLE 1

| COATING # | TIO2-WT % | STABILIZER-WT % | L.T. STABILIZER WT % | STEA-RATE |
|---|---|---|---|---|
| SAMPLE 1 | APG-12.5 | IRG 1076-0.10 | ZNO-3.0 | Ca |
| SAMPLE 2 | R104-11.2 | GA 80-0.08 | HOS N 30-0.075 | Ca |
| SAMPLE 3 | R104-13.3 | GA80-0.08 | HOS N 30-0.075 | Ca |
| SAMPLE 4 | R104-15.7 | GA 80-0.08 | HOS N 30-0.075 | Ca |
| SAMPLE 5 | R104-11.8 | GA 80-0.08 | HOS N 30-0.075 | Ca |
| SAMPLE 6 | APG-12.5 | IRG 1076-0.10 | ZNO-3.0 | Ca |
| SAMPLE 7 | APG-12.5 | IRG 1076-0.10 | ZNO-3.0 | Ca |
| SAMPLE 8 | R104-13.7 | GA 80-0.08 | HOS N 30-0.075 | Ca |
| SAMPLE 9 | R104-14.2 | NONE | CHIM 944-0.11 | Zn |
| SAMPLE 10 | R104-11.6 | GA 80-0.08 | HOS N 30-0.075 | Na |
| SAMPLE 11 | R104-11.7 | GA 80-0.08 | HOS N 30-0.075 | Zn |
| SAMPLE 12 | APG-12.5 | IRG 1076-0.10 | ZNO-3.0 | Ca |
| SAMPLE 13 | APG-12.5 | IRG 1076-0.10 | ZNO-3.0 | Ca |
| SAMPLE 14 | R104-12.0 | GA 80-0.08 | HOS N 30-0.075 | Zn |
| SAMPLE 15 | R104-12.0 | GA 80-0.08 | HOS N 30-0.075 | Zn |

R104 is a rutile titanium dioxide, commercially available from DuPont Corp.

GA 80 is a processing stabilizer, Sumilizer® GA-80 (ST112CF) manufactured by Sumitomo Chemical Co. Ltd. and has the following structure:

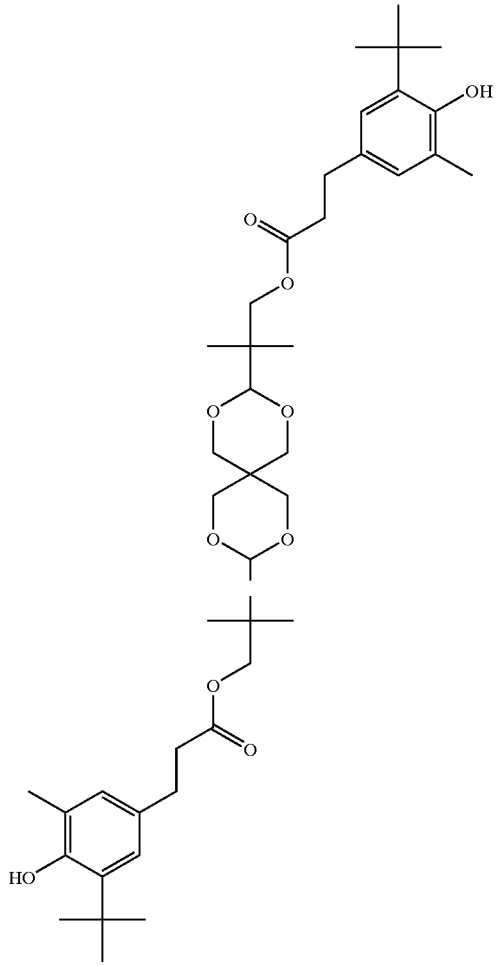

TABLE 2

| SAMPLE # | DK FADE 4WK/85C |
|---|---|
| 1 (control) | −0.094 |
| 2 | −0.048 |
| 3 | −0.039 |
| 4 | −0.028 |
| 5 | −0.024 |
| 6 (control) | −0.095 |
| 7 (control) | −0.134 |
| 8 | −0.005 |
| 9 (comparison) | −0.115 |
| 10 | −0.007 |
| 11 | −0.022 |
| 12 (control) | −0.092 |
| 13 (control) | −0.099 |
| 14 | −0.041 |
| 15 | −0.042 |

Table 2 illustrates that the incorporation of Hostavin N 30 (abbreviated herein as HOS N 30) as the long term resin stabilizer provides an improvement in the dark fade performance of the yellow dye, as compared to the prior art stabilizers of ZnO or hindered amine light stabilizer Chimassorb® 944.

Example 2

As with Example 1, Example 2 was coated using Coating Format 1 above. The support control samples, Samples 16 and 17 were made as described in Sample 1 of Example 1. The other samples were made as described in Table 3.

TABLE 3

| SAMPLE # | TIO2-WT % | STABILIZER-WT % | L.T. STABILIZER-WT % | STEA-RATE |
|---|---|---|---|---|
| SAMPLE 16 | APG-12.5 | IRG 1076-0.10 | ZNO-3.0 | Ca |
| SAMPLE 17 | APG-12.5 | IRG 1076-0.10 | ZNO-3.0 | Ca |
| SAMPLE 18 | APG-14.5 | GA 80-0.08 | HOS N30-0.075 | Zn |
| SAMPLE 19 | APG-14.5 | GA 80-0.08 | HOS N30-0.075 | Ca |
| SAMPLE 20 | APG-12.5 | IRG 1076-0.10 | HOS N30-0.075 | Ca |
| SAMPLE 21 | APG-12.5 | GA 80-.067 | ZNO-3.0 | Ca |

TABLE 4

| COATING # | DK FADE 4WK/85C |
|---|---|
| 16 (control) | −0.111 |
| 17 (control) | −0.156 |
| 18 | —0.04 |
| 19 | −0.023 |
| 20 | −0.054 |
| 21 (control) | −0.146 |

This example evaluated the effect of hindered amine light stabilizer Hostavin N 30 without the GA 80 process stabilizer, and also the effect of the process stabilizer GA 80 without the hindered amine light stabilizer Hostavin N 30. The hindered amine light stabilizer was combined with Irganox 1076 as the process stabilizer in this example. Table 4 again illustrates that the Hostavin N30 provides a significant improvement in dark fade as compared to ZnO.

Example 3

In Example 3, the yellow layer of Coating Format 1 was varied as described below in Table 5. The other portions of Coating Format 1 remained the same. In summary, the yellow coupler used in examples 1 and 2 was coated in the same composition, which is Sample 22, and in an alternate composition which is described in Table 5. Also, additional yellow coupler molecules were added.

The other yellow couplers were coated as described in Table 5. The gelatin and blue sensitive silver for all parts of Example 3 were coated the same as in Examples 1 and 2. All units in this table are mg/square meter

TABLE 5

| COATING # | YC | YCLAY DOWN | ST-6 | ST-7 | ST-24 | ST-21 | SOLVENT | AMT. SOLVENT |
|---|---|---|---|---|---|---|---|---|
| 23 | YC-2 | 414 | 85.5 | | 85.5 | 85.5 | S-13 | 217.9 |
| 24 | YC-1 | 538 | 92.5 | 30.8 | | (−) | S-3 | 235 |
| 25 | YC-18 | 538 | 92.5 | 30.8 | | (−) | S-3 | 235 |

TABLE 5-continued

| COATING # | YC | YCLAY DOWN | ST-6 | ST-7 | ST-24 | ST-21 | SOLVENT | AMT. SOLVENT |
|---|---|---|---|---|---|---|---|---|
| 26 | YC-6 | 538 | 92.5 | 30.8 | | (–) | S-3 | 235 |
| 27 | YC-19 | 538 | 92.5 | 30.8 | | (–) | S-3 | 235 |

The yellow variations in Example 3 were coated on Support 1, that used ZnO as the long term stabilizer and Irganox 1076 as the process stabilizer and corresponds to the control sample, Sample 1, of Example 1. The yellow variations were also coated on Support 2, which used Hostavin® N30 as the long term stabilizer and GA 80 as the process stabilizer and corresponds to the inventive samples of Example 1. The results in Table 6 and Table 7 show that inventive Support 2, which used Hostavin®N30, provides an improvement in dark fade performance relative to Support 1, the control which used ZNO.

TABLE 6

| SAMPLE # | YELLOW COUPLER | 4WK 85C/50% RH SUPPORT 1 | 4WK 85C/50% RH SUPPORT 2 |
|---|---|---|---|
| 22 | YC-2 | −0.1325 | −0.058 |
| 23 | YC-2 | −0.135 | −0.0895 |
| 24 | YC-1 | −0.13 | −0.1055 |
| 25 | YC-18 | −0.09 | −0.089 |
| 26 | YC-6 | −0.2355 | −0.2355 |
| 27 | YC-19 | −0.149 | −0.145 |

TABLE 7

| SAMPLE # | YELLOW COUPLER | 8WK 75C/50% RH SUPPORT 1 | 8WK 75C/50% RH SUPPORT 2 |
|---|---|---|---|
| 22 | YC-2 | −0.0995 | −.074 |
| 23 | YC-2 | −0.0805 | −.0615 |
| 24 | YC-1 | −0.0885 | −.066 |
| 25 | YC-18 | −0.0615 | −.0515 |
| 26 | YC-6 | −0.18 | −0.17 |
| 27 | YC-19 | −0.099 | −.092 |

The invention has been described in detail with particular reference to certain preferred embodiments thereof, but it will be understood that variations and modifications can be effected within the spirit and scope of the invention.

What is claimed is:

1. An imaged element comprising at least one imaged layer comprising at least one yellow dye and a support, wherein said support comprises at least one face side resin layer comprising a material capable of improving the yellow dark stability of said imaged element, wherein said material has the formula:

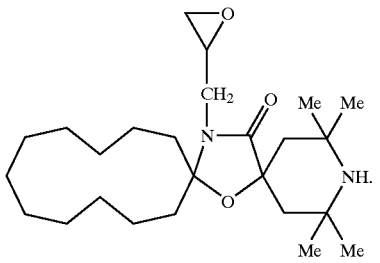

2. The imaged element of claim 1 wherein said material comprises a polymer.

3. The imaged element of claim 1 wherein said material comprises from 0.01 to 5% by weight of the face side resin layer.

4. The imaged element of claim 1 wherein said support comprises a reflective support.

5. The imaged element of claim 4 wherein said reflective support comprises paper.

6. The imaged element of claim 4 wherein said reflective support comprises synthetic paper.

7. The imaged element of claim 1 wherein said face side resin layer is on the top side of said support.

8. The imaged element of claim 4 further comprising a bottom layer on said support comprising polyolefin polymer containing a hindered amine light stabilizer.

9. The imaged element of claim 1 wherein said material improves said yellow dark stability by greater than 10%.

10. The imaged element of claim 1 wherein said imaged layer comprises a photosensitive silver halide layer.

11. The imaged element of claim 10 wherein said at least one yellow dye results from a yellow dye forming coupler.

12. The imaged element of claim 11 wherein said yellow dye forming coupler comprises acetanilide-based yellow dye forming coupler compounds.

13. The imaged element of claim 1 wherein said imaged layer comprises an inkjet receiving layer.

14. The imaged element of claim 13 wherein said yellow dye results from the application of yellow inkjet dye droplets to said inkjet receiving layer.

15. The imaged element of claim 1 wherein said imaging layer comprises a thermal receiver layer.

16. The imaged element of claim 15 wherein said yellow dye results from the application of yellow dye from a thermal dye donor element.

17. The imaged element of claim 1 wherein said face side resin layer further comprises a white pigment.

18. The imaged element of claim 17 wherein said white pigment comprises titanium dioxide.

19. The imaged element of claim 18 wherein said face side resin layer comprises greater than 10% by weight titanium dioxide.

20. The imaged element of claim 18 wherein said face side resin layer comprises between 10% and 50% by weight titanium dioxide.

21. The imaged element of claim 18 wherein said white pigment comprises rutile titanium dioxide having a particle size of from 0.1 to 0.26 $\mu$m.

22. The imaged element of claim 1 wherein said face side resin layer further comprises red or blue colorants.

23. The imaged element of claim 22 wherein said red or blue colorants comprise cobalt or aluminate colorants.

24. The imaged element of claim 1 wherein said face side resin layer further comprises optical brighteners.

25. The imaged element of claim 1 wherein said face side resin layer further comprises tinting agents.

26. The imaged element of claim 1 wherein said face side resin layer further comprises other stabilizing agents.

27. The imaged element of claim 26 wherein said other stabilizing agents comprise melt stabilizing addenda.

28. The imaged element of claim 26 further comprising a phenolic antioxidant.

29. The imaged element of claim 26 further comprising a phosphite antioxidant.

30. The imaged element of claim 1 wherein said face side resin layer further comprises a slip agent.

* * * * *